United States Patent [19]

Hain

[11] Patent Number: 4,955,964

[45] Date of Patent: Sep. 11, 1990

[54] SHEET HANDLING APPARATUS

[75] Inventor: David A. Hain, Dundee, Scotland

[73] Assignee: NCR Corporation, Dayton, Ohio

[21] Appl. No.: 282,722

[22] Filed: Dec. 12, 1988

[30] Foreign Application Priority Data

Aug. 19, 1988 [GB] United Kingdom ..... 8819768

[51] Int. Cl.[5] ..... B65H 5/00

[52] U.S. Cl. ..... 271/225; 271/227; 271/270; 271/202; 271/302; 271/182; 271/184

[58] Field of Search ..... 271/270, 202, 203, 302, 271/182, 192, 184, 185, 315, 188, 225, 226, 227, 234, 239, 240

[56] References Cited

U.S. PATENT DOCUMENTS

| | | | |
|---|---|---|---|
| 3,512,771 | 5/1970 | Dempsey et al. | 271/3 |
| 3,885,664 | 5/1975 | Fujimura | 271/184 X |
| 4,093,203 | 6/1978 | Fischer et al. | 271/202 X |
| 4,462,509 | 7/1984 | Adelberger | 221/259 |
| 4,516,759 | 5/1985 | Kobler | 271/182 X |
| 4,638,993 | 1/1987 | Granzow et al. | 271/315 |
| 4,645,194 | 2/1987 | Stobb | 271/203 |

FOREIGN PATENT DOCUMENTS

| | | | |
|---|---|---|---|
| 0071421 | 7/1982 | European Pat. Off. . | |
| 0143188 | 5/1985 | European Pat. Off. . | |
| 1120259 | 12/1961 | Fed. Rep. of Germany | 271/185 |
| 786014 | 8/1935 | France . | |
| 0015348 | 1/1985 | Japan | 271/188 |
| 0096246 | 5/1987 | Japan | 271/227 |
| 105542 | 1/1917 | United Kingdom . | |
| 858463 | 1/1961 | United Kingdom | 271/64 |
| 2082150 | 3/1982 | United Kingdom . | |
| 2091225 | 7/1982 | United Kingdom . | |
| 2128169 | 9/1982 | United Kingdom . | |
| 2137966 | 4/1983 | United Kingdom . | |
| 2135977 | 1/1984 | United Kingdom . | |

*Primary Examiner*—H. Grant Skaggs
*Assistant Examiner*—Boris Milef
*Attorney, Agent, or Firm*—Wilbert Hawk, Jr.; Albert L. Sessler, Jr.; Elmer Wargo

[57] ABSTRACT

A sheet handling apparatus includes first and second endless belts (38, 40) which are of resiliently stretchable material and parts of which are in cooperative relationship with respect to each other, a sheet (68) being fed through the apparatus while gripped between the cooperating parts of the belt drives (38, 40). One of the belt drives (40) passes around a pulley (60) associated with selectively operable actuating members (42, 46, 50, 52, 54). Operation of the actuating members (42, 46, 50, 52, 54) moves the associated pulley (60) so as to bring out a deformation of the cooperating parts of the belt drives (38, 40) and thereby change the length of the feed path for the sheet (68) through the apparatus. By operating the actuating members (42, 46, 50, 52, 54), the time at which the sheet (68) arrives at a certain location, such as a stacking wheel 75, may be adjusted. By using two pairs of cooperating belt drives of this type, the orientation of a sheet passing between the cooperating belt drives may be adjusted.

5 Claims, 7 Drawing Sheets

SHEET HANDLING APPARATUS

BACKGROUND OF THE INVENTION

This invention relates to a sheet handling apparatus. In particular, the invention relates to an apparatus for transporting sheets in a controlled manner, whereby the time at which a sheet arrives at a certain point may be adjusted, or the orientation of a sheet relative to the direction of travel may be adjusted.

The invention has application, for example, to a currency note stacking mechanism included in a cash dispenser unit of an automated teller machine (ATM). As is well known, in operation of an ATM a user inserts a customer identifying card into the machine and then enters certain data (such as codes, quantity of currency required, type of transaction, etc.) upon one or more keyboards associated with the machine. The machine will then process the transaction, update the user's account to reflect the current transaction, dispense cash, when requested, from one or more currency cassettes mounted in the machine, and return the card to the user as part of a routine operation.

A cash dispenser unit of an ATM conventionally includes at least one note picking mechanism for extracting notes one by one from a currency cassette, and a stacking and presenting mechanism for accumulating the extracted notes into a stack and then feeding the stack of notes to a delivery port or exit slot in the ATM from where the stack may be removed by a user of the ATM.

A well known type of currency note stacking mechanism includes a stacking wheel which continuously rotates in operation and which incorporates a series of curved tines. Notes are fed one by one to the stacking wheel, and they successively enter compartments formed between adjacent tines and are carried partly around the axis of the wheel before being stripped from the wheel by a stationary pick-off member and formed into a stack.

In a known cash dispenser mechanism having a stacking wheel, the note picking means and the stacking wheel are operated in synchronism so that in normal operation successive notes arriving at the stacking wheel are fed into successive compartments of the wheel. Certain problems have been experienced with such known mechanisms. For example, if the leading edge of a picked note is folded, then this leading edge may hit the end of one of the tines instead of being inserted into one of the compartments, thereby possibly causing the note to fail to be dispensed to a customer, or possibly damaging the note or causing jamming of the stacking wheel or some associated mechanism to occur. Also, if the note picking means incorporates a friction feed means, then it is possible that in some situations slippage between a picked note and the feeding means may occur, which may again cause the leading edge of the note to hit the end of one of the tines of the stacking wheel.

Another application of the present invention is to a system for verifying currency notes. A note verification system often includes detector means for generating an electric signal in response to the recognition of a feature or the absence of a feature on a note and comparing this signal with a standard signal. For proper operation of such a system it is important that a note should arrive at the detector means with an accurately correct orientation relative to the detector means. From U.K. patent application No. 2128169A there is known a mechanism for removing skew from a note prior to the note arriving at a detector station of a note verification system. In operation of this known mechanism, if skew in a note is detected, this note is diverted into a looped path comprising two belt transport means, one of which provides a longer path length than the other. This looped path provides a fixed amount of skew correction for each circulation of the note. This known skew correction apparatus has the disadvantages that means must be provided for ensuring that a skewed note enters the looped path with its leading corner positioned for engagement by the longer belt means, and that only a fixed amount of skew can be removed for each circulation of a note.

SUMMARY OF THE INVENTION

It is an object of the present invention to provide a sheet handling apparatus which alleviates the problems and disadvantages referred to above and experienced with known sheet handling mechanisms.

According to the invention, there is provided a sheet handling apparatus including first and second belt means, parts of which are in cooperative relationship with respect to each other, and means for driving said belt means so that, in operation, a feeding movement of a sheet is brought about while said sheet is gripped between said parts of said first and second belt means, characterized by means for altering the paths of movement of said parts of said belt means whereby the length of a feed path between first and second fixed points for at least part of said sheet may be varied.

Preferred embodiments of the invention will now be described by way of example with reference to the accompanying specification, claims and drawing.

DESCRIPTION OF THE PREFERRED EMBODIMENTS

Figure 1:
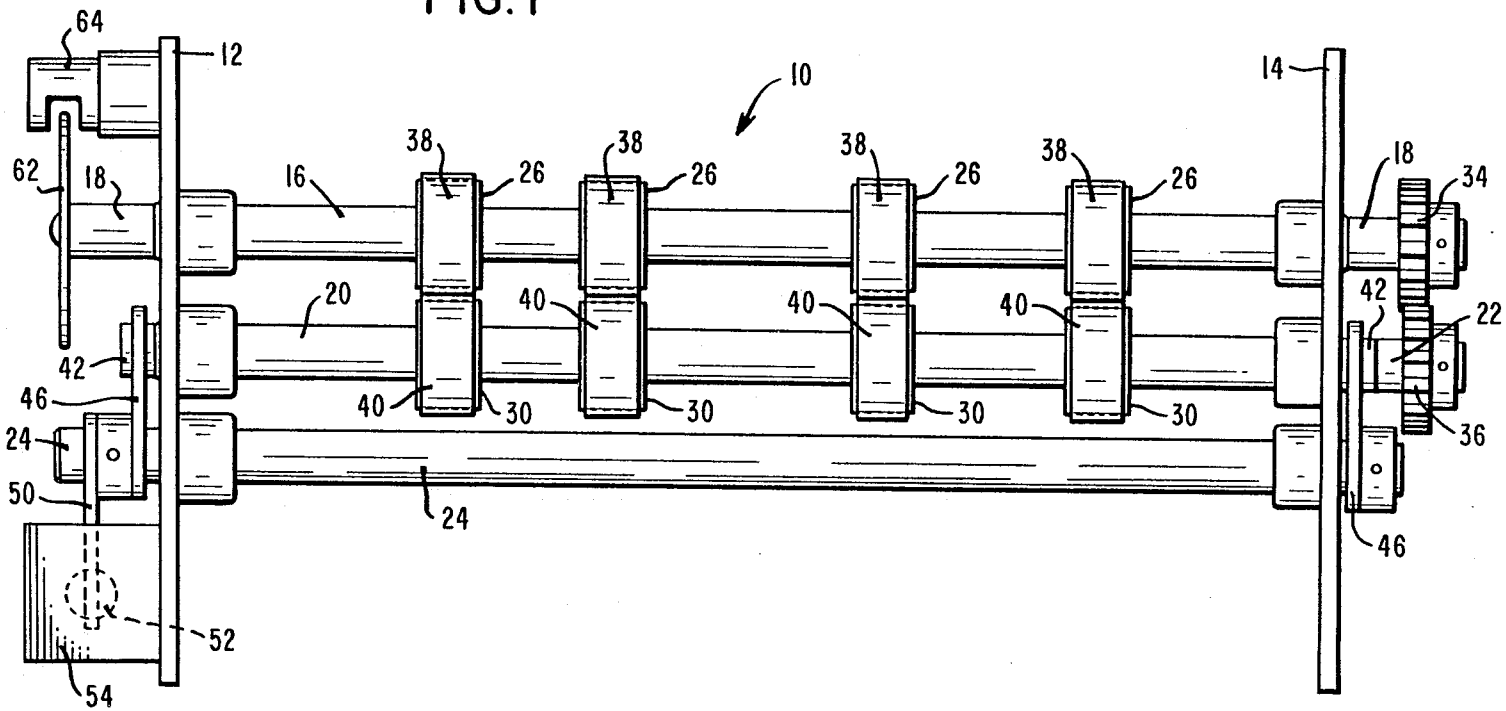
FIG. 1 is an end elevational view of a currency note retard mechanism made in accordance with this invention.
Figure 2:
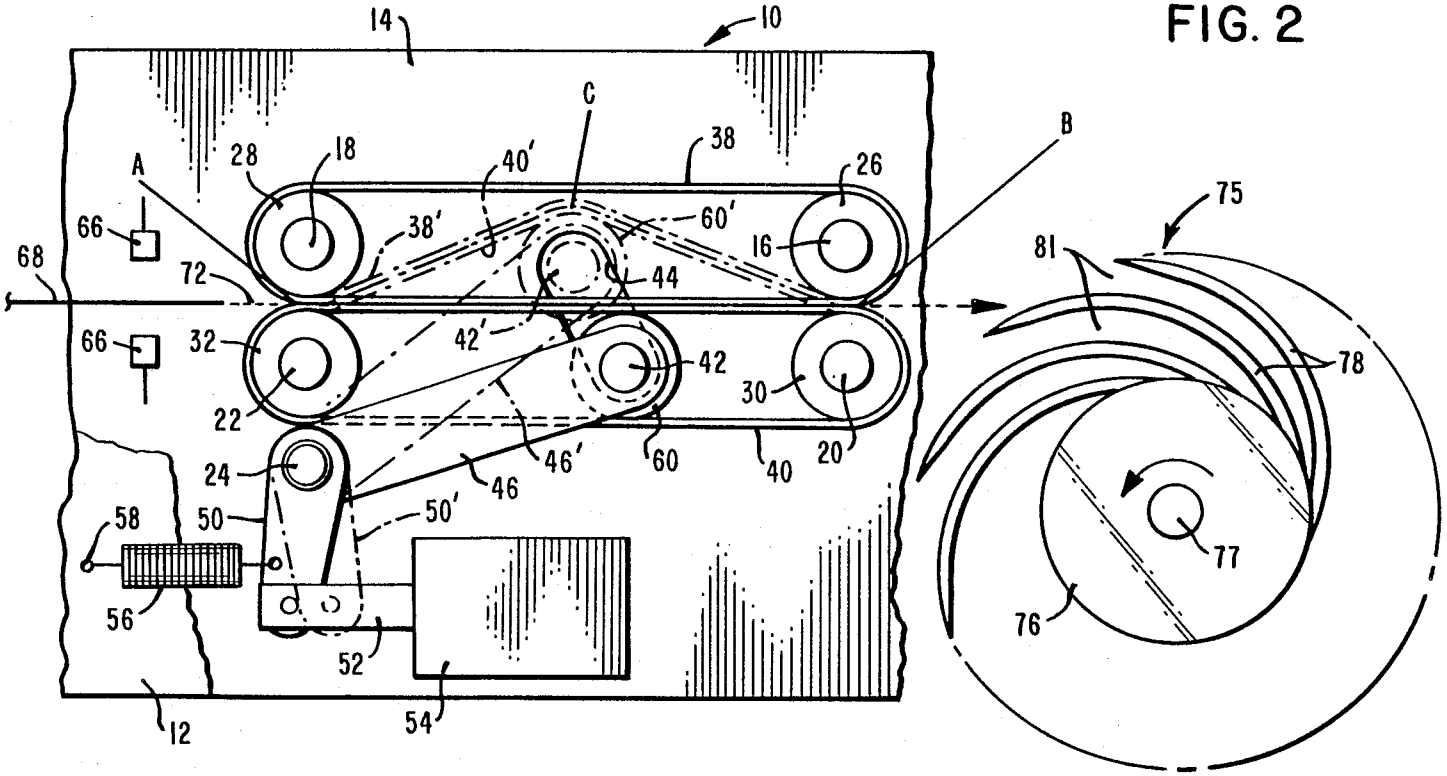
FIG. 2 is a side elevational view of the mechanism of FIG. 1, this view being taken from the left hand side of FIG. 1.

Referring to FIGS. 1 and 2, a currency note retard mechanism 10 in accordance with the invention includes a supporting framework having parallel side walls 12 and 14. Five shafts 16, 18, 20, 22 and 24, having fixed parallel axes of rotation, extend between, and are rotatably mounted with respect to, the side walls 12 and 14. A first series of upper pulleys 26 are secured on the shaft 16, a second series of upper pulleys 28 are secured on the shaft 18, a third series of lower pulleys 30 are secured on the shaft 20, and a fourth series of lower pulleys 32 are secured on the shaft 22. The pulleys 26, 28, 30 or 32 of each series are spaced apart along the respective shafts 16, 18, 20 or 22 with the pulleys of each series being respectively aligned with the corresponding pulleys of the other series. The right hand ends (with reference to FIG. 1) of the shafts 18 and 22 project beyond the side wall 14, and have respectively secured thereon meshing gear wheels 34 and 36 which are driven by an electric motor (not shown) via transmission means (not shown).

The mechanism 10 also includes a first series of endless belts 38 and a second series of endless belts 40. Each belt 38 passes around a corresponding pair of the upper pulleys 26 and 28, and each belt 40 passes around a corresponding pair of the lower pulleys 30 and 32, with corresponding pairs of the belts 38 and 40 being in cooperative engagement with each other as seen in FIGS. 1 and 2. The belts 38 and 40 are of an elastomeric material such as polyurethane or silicone rubber, and are designed to be resiliently stretchable for a purpose which will be explained hereinafter.

A further shaft 42 extends between the side walls 12 and 14 with its axis parallel to the axes of the shafts 16, 18, 20, 22 and 24, the shaft 42 passing through two elongated slots 44 (FIG. 2) respectively formed in the side walls 12 and 14. The shaft 42 is carried by a pair of support arms 46 which are respectively disposed adjacent the outer faces of the side walls 12 and 14. The ends of the shaft 42 pass through, and are secured to, corresponding ends of the arms 46. The other ends of the arms 46 are secured to the shaft 24 so that a rotational movement of the shaft 24 brings about a rotational movement of the arms 46 about the axis of the shaft 24. A downwardly extending arm 50 is secured to that end of the shaft 24 projecting beyond the side wall 12, the lower end of the arm 50 being pivotably connected to an armature 52 of a solenoid 54. The arm 50 is biased to rotate in a clockwise direction (with reference to FIG. 2) by means of a tension spring 56, the ends of which are respectively connected to the arm 50 and to a stud 58 secured to the side wall 12. A series of four pulleys 60 are rotatably mounted on the shaft 42. The pulleys 60 and the pulleys 30 and 32 all have the same diameter, and the pulleys 60 are positioned on the shaft 42 so as to be respectively disposed inside, and in engagement with, the four endless belts 40. When the shaft 42 is in its normal position as shown in solid outline in FIG. 2, each pulley 60 is disposed between the corresponding pulleys 30 and 32 with its axis lying in the same plane as the axes of the corresponding pulleys 30 and 32.

A timing disc 62 (FIG. 1) is secured to that end of the shaft 18 projecting beyond the side wall 12, the disc 62 carrying a series of radially extending marks (not seen) equally spaced around the axis of the shaft 18. The disc 62 cooperates with an optical sensor 64 mounted on the side wall 12, and in operation, the sensor 64 generates a series of timing pulses in response to the sensing of the marks carried by the disc 62. Further optical sensor means 66 (FIG. 2) are disposed between the side walls 12 and 14 and are mounted on one of the side walls 12 and 14. The sensor means 66 are arranged to sense the approach of a currency note 68 to the entry nip A between the belts 38 and 40, such note 68 being fed by feed means (not shown in FIGS. 1 and 2) along a feed path 72.

Figure 3:
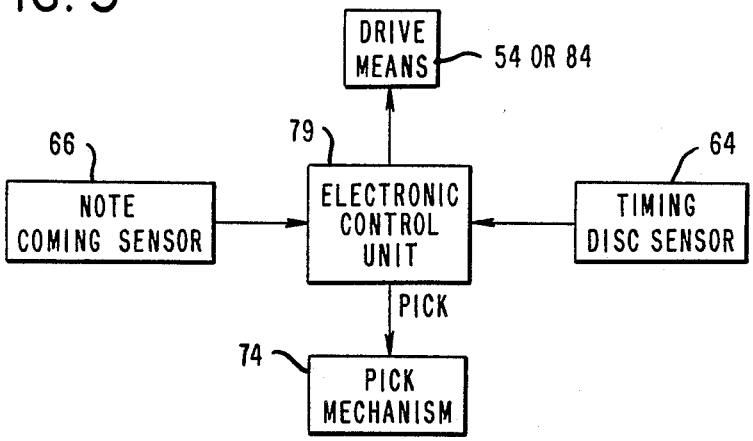
FIG. 3 is a schematic block diagram illustrating the electrical interconnections of parts of an apparatus including the mechanisms of FIGS. 1 and 2 or the mechanism of FIG. 4.

The operation of the currency note retard mechanism 10 will now be described with additional reference to FIG. 3. It should be understood that the mechanism 10 is included in a cash dispenser unit 73 (FIG. 5) of an ATM in which currency notes 68 are fed, one by one, from a note pick mechanism 74 (FIGS. 3 and 5) through the retard mechanism 10 (FIGS. 2 and 5) to a conventional stacking wheel 75. The stacking wheel 75 comprises a plurality of stacking plates 76 spaced apart in parallel relationship along the stacker wheel shaft 77, each plate 76 incorporating a series of curved tines 78. A note picking and stacking operation is initiated by an electronic control unit 79 (FIG. 3) sending a signal PICK to the pick mechanism 74. In response to receipt of the signal PICK by the pick mechanism 74, a currency note 68 is picked from a currency cassette 89 (FIG. 5) and is transported past the sensor means 66 to the entry nip A of the retard mechanism 10. Normally, the solenoid 54 is in a de-energized condition, and with the solenoid 54 in this condition, the assembly of the arms 46 and 50, the shaft 42, and the pulleys 60 is held by the spring 56 in the position shown in solid outline in FIG. 2. As previously mentioned, when the mechanism 10 is in its normal position (with the solenoid 54 de-energized), the axis of each of the pulleys 60 lies in the same plane as the axes of the corresponding pulleys 30 and 32. Thus, normally the cooperating parts of the belts 38 and 40 extend along a straight path aligned with the feed path 72. Upon the leading edge of a picked currency note 68 (FIG. 2) being sensed by the sensor means 66, a signal is sent by the sensor means 66 to the electronic control unit 79, and in response to receiving this signal the electronic control unit 79 determines whether the leading edge of this currency note 68 has reached the sensor means 66 at the correct moment in time for correct stacking. This determination is made on the basis of how many timing signals have been received by the electronic control unit 79 from the timing disc sensor 64 in the time interval between the generation of the relevant signal PICK and the receipt by the unit 79 of the signal from the sensor means 66.

If the electronic control unit 79 (FIG. 3) determines that the currency note 68 has arrived at the sensor means 66 at the correct moment in time, then the solenoid 54 (FIG. 2) remains de-energized and, after entering the entry nip A, the note 68 is gripped by the cooperating parts of the belts 38 and 40 and is transported by the belts 38 and 40 along a straight path aligned with the feed path 72. After leaving the retard mechanism 10 at the exit line of contact B between the belts 38 and 40, the leading edge of the note 68 is fed into one of the compartments 81 formed between adjacent sets of tines 78 of the stacking wheel 75, after which the stacking of the note 68 is completed. If the electronic control unit 79 determines that the note 68 has not arrived at the sensor means 66 at the correct moment in time, as a result of which the leading edge of the note 68 would be liable to hit the end of one of the tines 78 of the stacking wheel 75 if the note 68 were to be fed straight through the mechanism 10 as described above, then the unit 79 sends a signal to the solenoid 54 so as to energize the solenoid 54. Upon the solenoid 54 being energized, the arm 50 is caused to be rotated by the armature 52, against the action of the spring 56, to the position 50' shown in dashed outline in FIG. 2. This rotation of the arm 50 in turn causes the arms 46, the shaft 42 and the pulleys 60 to be moved to the positions 46', 42' and 60' shown in dashed outline in FIG. 2, the shaft 42 moving along the slots 44 in the side walls 12 and 14. Movement of the pulleys 60 to the position 60' brings about a deformation of the cooperating parts of the belts 38 and 40 into new positions 38' and 40' shown in dashed outline FIG. 2. It will be appreciated that the stretchable nature of the belts 38 and 40 makes it possible for the cooperating parts of the belts 38 and 40 to be deformed in this manner. With reference to FIG. 2, the note 68 will now follow a path ACB, where C is a contact point between the belts 38 and 40 where they bend partly around the pulleys 60. It will be appreciated that the path ACB is significantly longer than the fixed straight path AB, and the extent of movement of the shaft 42 is so chosen that the difference in lengths between the paths ACB and AB is such that the note 68 is delayed by a period sufficient to cause it to enter correctly into that compartment 81 of the stacking wheel 75 next following the compartment 81 which it would have entered if this note 68 had arrived at the sensor means 66 at the correct moment in time and had followed the straight feed path AB.

An advance and retard mechanism 82 will now be described with reference to FIG. 4. Certain elements of the mechanism 82 correspond to elements of the retard mechanism 10 shown in FIGS. 1 and 2, and corresponding elements of the mechanisms 82 and 10 have been given the same reference numerals. Thus, the advance and retard mechanism 82 includes a first series of endless belts 38 of resiliently stretchable material which pass around pulleys 26 and 28 carried on shafts 16 and 18, and a second series of endless belts 40 of resiliently stretchable material which pass around pulleys 30 and 32 carried on shafts 20 and 22. Also, the mechanism 82 includes a series of pulleys 60 rotatably mounted on a shaft 42, the pulleys 60 being respectively disposed inside, and in engagement with, the endless belts 40, and the ends of the shaft 42 passing through, and being secured to, corresponding ends of a pair of support arms 46 the other ends of which are secured to a shaft 24. Additionally, the mechanism 82 includes: a timing disc 62; a timing disc sensor 64 as previously described with reference to FIG. 1, but not shown in FIG. 4; and an optical sensor means 66.

Figure 4:
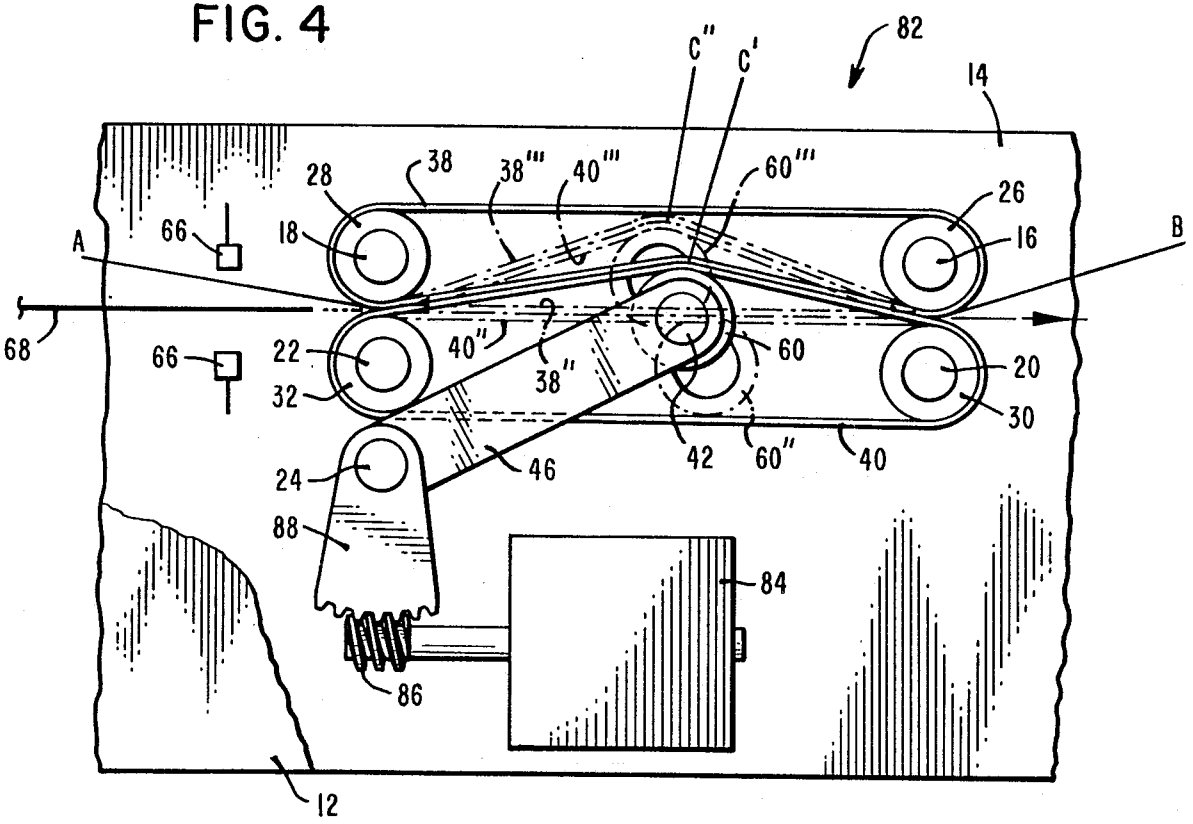
FIG. 4 is a side elevational view of a currency note advance and retard mechanism made in accordance with the invention.

In contrast with the retard mechanism 10, when the mechanism 82 (FIG. 4) is in its normal position, the axis of the shaft 42 lies above the plane containing the axes of the shafts 20 and 22, so that the cooperating parts of the belts 38 and 40 are bent away from the plane containing the entry nip A and the exit line of contact B between the belts 38 and 40, the normal positions of the belts 38 and 40 being as shown in solid outline in FIG. 4 with the belts 38 and 40 each being in a tensioned (stretched) condition. If a picked currency note 68 arrives at the sensor means 66 of the mechanism 82 at the correct moment in time, the belts 38 and 40 will remain in their normal positions, and this note 68 will pass through the mechanism 82 along a feed path AC'B, where C' is a contact point between the belts 38 and 40 where they bend partly around the pulleys 60. Again in contrast with the retard mechanism 10, the drive means for bringing about movement of the assembly of the arms 46, the shaft 42 and the pulleys 60 of the mechanism 82 comprises a bidirectional electric motor 84 in place of the solenoid 54 of the mechanism 10. The motor 84 drives a worm gear 86 which is in engagement with a gear segment 88 secured to the shaft 24.

The operation of the advance and retard mechanism 82 (FIG. 4) will now be described with additional reference to FIG. 3. A note 68 is picked from a currency cassette (not shown in FIG. 4) and fed to the sensor means 66. As previously mentioned, when the mechanism 82 is in its normal position, the belts 38 and 40 are in the positions shown in solid outline in FIG. 4. At this time, the motor 84 is in a de-energized condition. Upon the leading edge of the picked currency note 68 being sensed by the sensor means 66, a signal is sent by the sensor means 66 to the electronic control unit 79 (FIG. 3), and in response to receiving this signal the electronic control unit 79 determines whether the leading edge of this currency note 68 has reached the sensor means 66 at the correct moment in time for correct stacking, or whether the note 66 has arrived at the sensor means 66 too early or too late for correct stacking. As in the case of the retard mechanism 10, this determination is made on the basis of how many timing signals have been received by the electronic control unit 79 from the timing disc sensor 64 in the time interval between the generation of the relevant signal PICK and the receipt by the electronic control unit 79 of the signal from the sensor means 66.

If the electronic control unit 79 determines that the currency note 68 has arrived at the sensor means 66 (FIG. 4) at the correct moment in time, then the motor 84 remains in a de-energized condition, and, after entering the entry nip A, the note 68 is gripped by the cooperating parts of the belts 38 and 40 and is transported by the belts 38 and 40 along the feed path AC'B. After leaving the mechanism 82, the leading edge of the note 68 is fed into one of the compartments 81 of the stacking wheel 75 (FIGS. 2 and 5), after which the stacking of the note 68 is completed. If the electronic control unit 79 determines that the note 68 has arrived at the sensor means 66 too late, as a result of which the leading edge of the note 68 would be liable to hit the end of one of the tines 78 of the stacking wheel 75 if the note 68 were to be fed along the feed path AC'B, then the unit 79 sends an appropriate signal to the motor 84 so as to energize the motor 84 in such a sense as to cause the worm gear 86 to rotate the gear segment 88 in a clockwise direction (with reference to FIG. 4) about the axis of the shaft 24. This rotation of the gear segment 88 brings about a rotation (in a clockwise direction) of the assembly of the arms 46, the shaft 42 and the pulleys 60. The clockwise rotation of said assembly continues until the pulleys 60 and the cooperating parts of the belts 38 and 40 reach the positions 60", 38" and 40" shown in FIG. 4, with the axis of the shaft 42 lying in the same plane as the axes of the shafts 20 and 22. At this time the motor 84 is de-energized so as to hold the belts 38 and 40 and the pulleys 60 in the positions 38", 40" and 60". It should be understood that the elastic nature of the belts 38 and 40 serves to maintain the belts 38 and 40, generally, in a taut condition even though their lengths have been reduced. The note 68 will now be transported through the mechanism 82 along the straight feed path AB. Since the feed path AB is shorter than the normal feed path AC'B, the note 68 is transported through the mechanism 82 in a shorter period of time than would have been the case if the note 68 had traveled along the normal feed path AC'B. The difference in lengths between the paths AC'B and AB is such that the note 68 is advanced by a period sufficient to cause it to enter correctly into that compartment 81 of the stacking wheel 75 which it would have entered if the note 68 had arrived at the sensor means 66 at the correct moment in time and had traveled along the feed path AC'B.

If the electronic control unit 79 determines that the note 68 has arrived at the sensor means 66 too early, as a result of which the leading edge of the note 68 would be liable to hit the end of one of the tines 78 if the note 68 were to be fed along the feed path AC'B, then the unit 79 sends an appropriate signal to the motor 84 so as to energize the motor 84 in the opposite sense to the sense previously mentioned, whereby rotation of the gear segment 88 in a counter-clockwise direction (with reference to FIG. 4) is brought about. This rotation of the gear segment 88 continues until the belts 38 and 40 and the pulleys 60 reach the positions 38''', 40''' and 60''' shown in dashed outline in FIG. 4, with the shaft 42 being positioned higher than its normal position. At this time the motor 84 is de-energized. The note 68 will now be transported through the mechanism 82 along a feed path AC''B, where C'' is a contact point between the belts 38 and 40 where they bend partly around the pulleys 60 when the pulleys are in position 60'''. Since the feed path AC''B is longer than the normal feed path AC'B, the note 68 is transported through the mechanism 82 in a longer period of time than would have been the case if the note 68 had traveled along the normal feed path AC'B. The extent of movement of the shaft 42 is so chosen that the difference in lengths between the paths AC''B and AC'B is such that the note 68 is retarded by a period sufficient to cause it to enter correctly into that compartment 81 of the stacking wheel 75 which it would have entered if the note 68 had arrived at the sensor means 66 at the correct moment in time and had traveled along the feed path AC'B.

The cash dispenser unit 73 incorporating the retard mechanism 10 will now be described in more detail with reference to FIG. 5. The unit 73 includes a plurality of currency cassettes 89 mounted in a stacked relationship, a stack of currency notes 68 being held in each cassette 89. When one or more currency notes 68 is or are to be dispensed from a particular cassette 89 in the course of a cash withdrawal operation, the associated pick mechanism 74 is operated so as to draw out of the cassette 89 the lower portion of the first note 68 in the stack contained in the cassette 89 and move this portion into a position where the leading edge of the portion is gripped by a first pair of drive rollers 90. This note 68 is then fed by the drive rollers 90 and by a series of further drive rollers 92 along the feed path 72 and via the retard mechanism 10 to the stacking wheel 75, the stacking wheel 75 continuously rotating in operation in a counter-clockwise direction (with reference to FIG. 5). The tines 78 of the stacking plates 76 pass between fingers 94 of a stripper plate assembly 96 pivotally mounted on a shaft 98. In operation, each note 68 which passes through the retard mechanism 10 enters one of the compartments 81 formed between adjacent sets of tines 78 and is carried partly around the axis of the stacking wheel 75, the note 68 being stripped from the wheel 75 by the fingers 94 and being staked against a belt 100 with a long edge of the note resting on the stripper plate assembly 96. As previously described, if the electronic control unit 79 (FIG. 3) determines that a note 68 has not arrived at the sensor means 66 at the correct moment in time (for example, due to the leading edge of the note being folded or due to note slippage occurring along the feed path 72), then the solenoid 54 (FIGS. 1 and 2) is energized thereby causing the note 68 to be delayed by the retard mechanism 10 by a period of time sufficient to cause the note 68 to enter correctly into one of the compartments 81.

Figure 5:
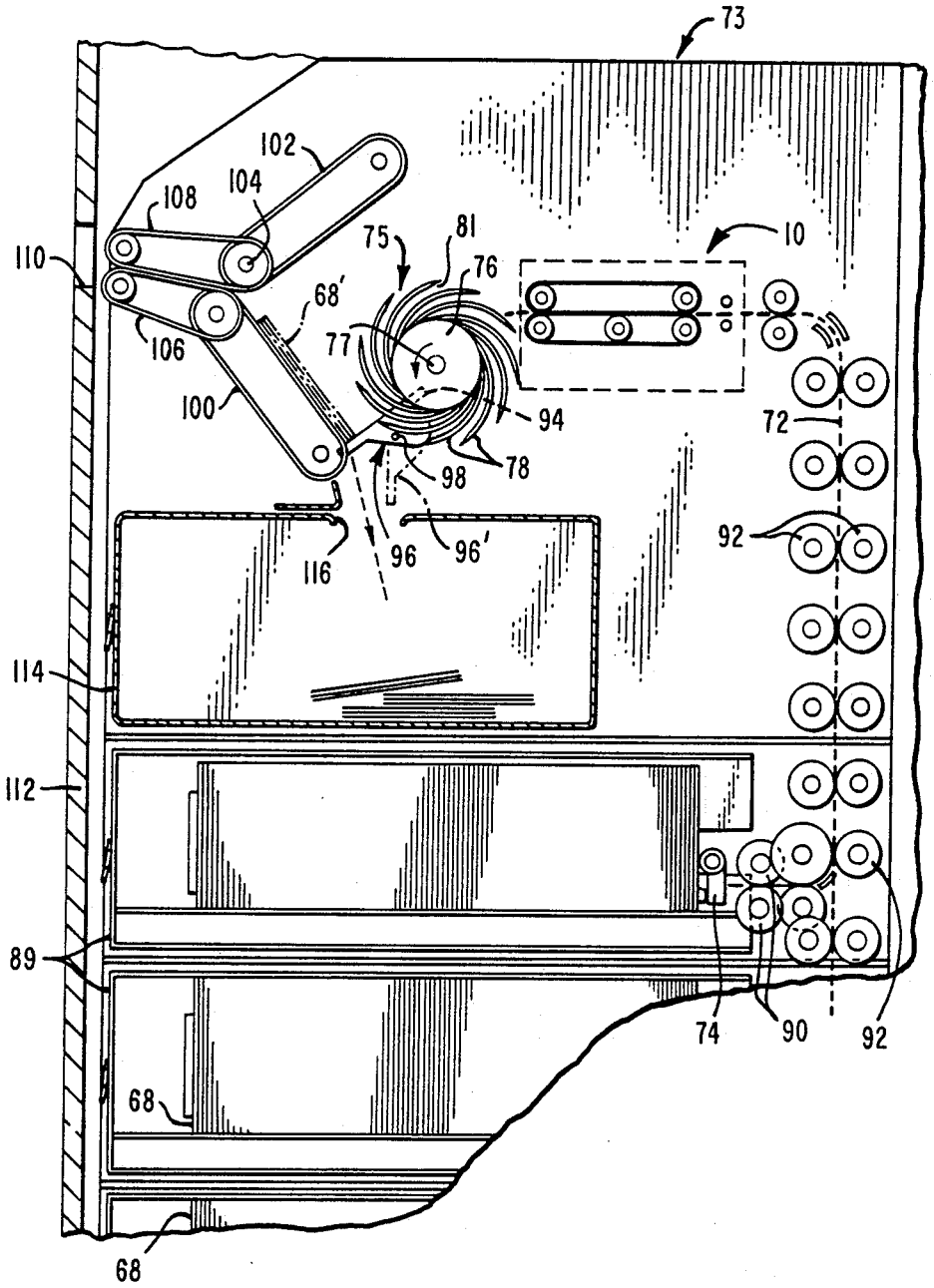
FIG. 5 is a schematic, side elevational view of a cash dispenser unit incorporating the retard mechanism of FIGS. 1 and 2 or the advance and retard mechanism of FIG. 4.

The belt 100 cooperates with a pair of belts 102 (only one of which is shown) which are pivotally mounted on a shaft 104 and which are normally held in the position shown in FIG. 5. When a bundle of notes 68' (or possibly a single note only) to be dispensed to a user in response to a cash withdrawal request has been stacked against the belt 100, the belts 102 are pivoted in a clockwise direction so as to trap the bundle of notes 68' between the belt 100 and the belts 102. It should be understood that in the course of this pivoting movement, the belts pass between adjacent pairs of the stacking plates 76. Assuming that none of the notes in the bundle 68' has been rejected for any reason, the belts 100 and 102 are operated so as to drive the bundle 68' to a pair of drive belts 106 and 108. The belts 106 and 108 serve to drive the bundle 68' through a note exit slot 110 in the housing 112 of the cash dispenser unit 73 to a position where the bundle 68' can be collected by the user of the ATM. It should be understood that the belts 100 and 102 are mounted in resilient relationship relative to each other, and the belts 106 and 108 are also mounted in resilient relationship relative to each other, so that bundles of notes of varying thickness can be held between, and fed by, the belts 100 and 102 and the belts 106 and 108. If a multiple feeding has been detected in the course of stacking the bundle of notes 68' against the belt 100, or if one or more of the notes in the bundle 68' has or have been rejected for any other reason, then the stripper plate assembly 96 is pivoted into the position shown in dashed outline 96' in FIG. 5, and the belts 100 and 102 are operated to feed the bundle 68' in a direction opposite to the normal feed direction, the bundle 68' being deposited in a reject note container 114 via an opening 116 in the top thereof.

It should be understood that the advance and retard mechanism 82 could be used in the cash dispenser unit 73 in place of the retard mechanism 10.

The retard mechanism 10 described with reference to FIGS. 1–3 and FIG. 5 has the advantages that it is of simple construction and is highly versatile in operation. Thus, the mechanism 10 can be operated to change the length of the feed path through the mechanism 10 at any time while a note 68 is being fed along the feed path 72, or even after the note 68 has entered the mechanism 10. The advance and retard mechanism 82 described with reference to FIG. 4 also has the just-mentioned advantages, and has the additional advantage that the length of the feed path through the mechanism 82 is infinitely variable. Further, by virtue of including the retard mechanism 10 or the advance and retard mechanism 82 in the cash dispenser unit 73, it is not necessary that the pick mechanism 74 and the stacking wheel 75 should operate in synchronism as is normally the case, thereby enabling the construction of the unit 73 to be simplified.

Figure 6:
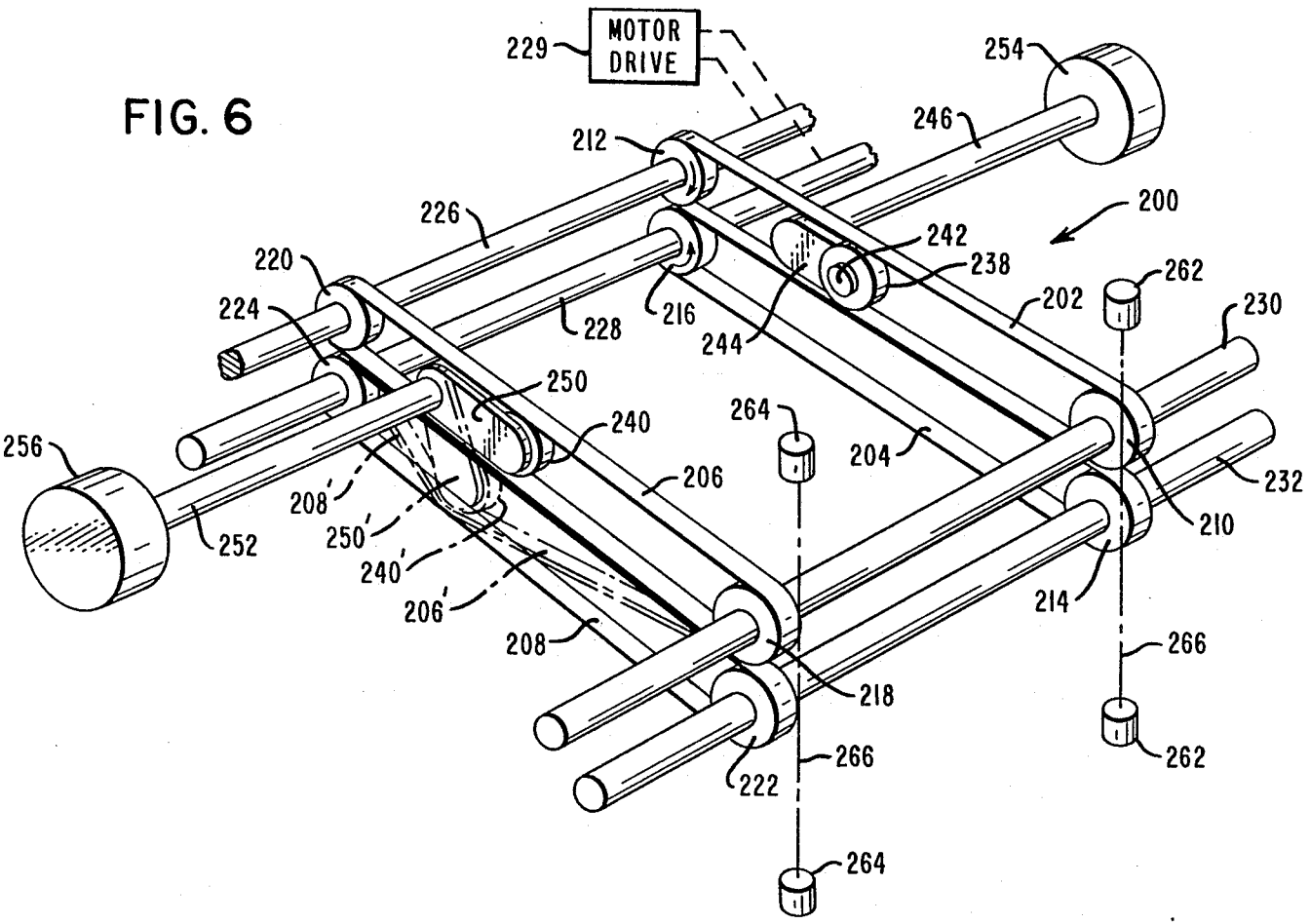
FIG. 6 is a schematic, perspective view of a currency note skew corrector mechanism in accordance with this invention.

A document skew corrector mechanism 200 will now be described with reference to FIGS. 6 and 7. The mechanism 200 includes four resiliently stretchable endless belts 202, 204, 206 and 208. The belts 202–208 are made of a material similar to that of which the belts 38 and 40 are made, that is to say an elastomeric material such as polyurethane or silicone rubber. The belt 202 passes around pulleys 210 and 212, the belt 204 passes around pulleys 214 and 216, the belt 206 passes around pulleys 218 and 220, and the belt 208 passes around pulleys 222 and 224. As seen in FIG. 6, the belts 202 and 204 are in cooperative engagement with each other and, similarly, the belts 206 and 208 are in cooperative engagement with each other. The pulleys 212 and 220 are secured on a drive shaft 226, and the pulleys 216 and 224 are secured on a drive shaft 228, the drive shafts 226 and 228 being driven by a motor drive 229 in the directions indicated by the associated arrows in FIG. 6. The pulleys 210 and 218 are rotatably mounted on a fixed shaft 230, and the pulleys 214 and 222 are rotatably mounted on a fixed shaft 232. All the shafts 226, 228, 230 and 232 extend between parallel side walls 234 and 236 (FIG. 7), the shafts 230 and 232 being secured to the walls 234 and 236, and the drive shafts 226 and 228 being rotatably mounted with respect to the walls 234 and 236.

Two further pulleys 238 and 240 (FIG. 7) are respectively disposed inside, and in cooperative engagement with, the endless belts 202 and 206. The pulley 238 is rotatably mounted on a stud 242 secured to one end of an arm 244, the other end of which is secured to one end of a shaft 246 which extends through, and is rotatably mounted with respect to, the side wall 234. Similarly, the pulley 240 is rotatably mounted on a stud 248 secured to one end of an arm 250, the other end of which is secured to one end of a shaft 252 which extends through, and is rotatably mounted with respect to, the side wall 236. The shafts 246 and 252 are respectively driven by bidirectional stepping motors 254 and 256, whereby the arms 244 and 250 may be selectively rotated about the axes of the shafts 246 and 252. Normally, the pulleys 238 and 240 and the arms 244 and 250 are in the positions shown in solid outline in FIG. 6, with the axis of the pulley 238 lying in the same plane as the axes of the pulleys 210 and 212, and with the axis of the pulley 240 lying in the same plane as the axes of the pulleys 218 and 220. For a reason to be explained later, in operation of the mechanism 200 the motor 256 may be operated for a selected period of time so as to rotate the assembly of the pulley 240 and arm 250 from the normal position in a clockwise direction (with reference to FIG. 6) into an actuated position 240', 250' such as is shown in dashed outline in FIG. 6. This movement of the pulley 240 brings about a deformation of the cooperating parts of the belts 206 and 208 into new positions 206', 208' shown in dashed outline in FIG. 6. It will be appreciated that the stretchable nature of the belts 206 and 208 makes it possible for the belts 206 and 208 to be deformed in this manner. Also, it should be understood that the amount of rotation of the assembly of the pulley 240 and arm 250 may be varied depending on the amount of deformation of the belts 206 and 208 that is required. Similarly, in operation of the mechanism 200, the motor 254 may be operated for a selected period of time so as to rotate the assembly of the pulley 238 and arm 244 from the normal position by a selected amount in a clockwise direction (with reference to FIG. 6) so as to bring about a deformation of the cooperating parts of the belts 202 and 204 in a similar manner to that in which the cooperating parts of the belts 206 and 208 are deformed. Each of the pulleys 238 and 240 may be returned to its normal position by appropriate operation of the associated motor 254 or 256 in the reverse sense, the resilient nature of the belts 202, 204, 206 and 208 serving to restore them to their normal positions shown in solid outline in FIG. 6.

A timing disc 258 (FIG. 7) is secured to that end of the shaft 226 projecting beyond the side wall 236, the disc 258 carrying a series of radially extending marks (not seen) equally spaced around the axis of the shaft 226. The disc 258 cooperates with an optical sensor 260 mounted on the side wall 236, and in operation, the sensor 260 generates a series of timing pulses in response to the sensing of the marks carried by the disc 258. First and second document sensor means 262 and 264 (FIG. 6) are disposed between the side walls 234 and 236 and are mounted on the side walls 234 and 236 by means not shown, with the axes 266 of the sensor means 262 and 264 lying in a plane parallel to the axes of the shafts 226–232. The sensor means 262 and 264 are arranged to sense the passage of the leading edge 268 of a document 270 (FIG. 7), such as a currency note, past the axes 266 of the sensor means 262 and 264 as the document 270 is fed (by means not shown) to the skew corrector mechanism 200 in the direction of the arrow 272.

Figure 8:
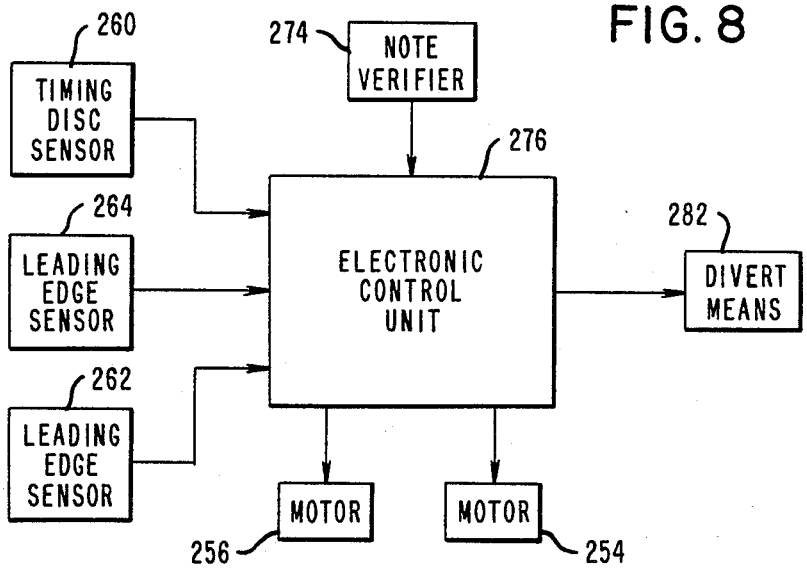
FIG. 8 is a schematic, block diagram illustrating the electrical interconnections of parts of an apparatus including the mechanism of FIGS. 6 and 7, with FIG. 8 appearing on the sheet containing FIG. 3.

Referring now additionally to FIG. 8, the operation of the skew corrector mechanism 200 when used in association with a currency note verifier 274 will now be described. As indicated in FIG. 7, after passing through the mechanism 200 a currency note 270 to be verified is fed (by means not shown) to the note verifier 274. In order for the note verifier 274 to operate properly it is essential that the note 270 arrives at the verifier 274 with an accurately correct orientation relative to the verifier 274. This correct orientation is obtained if the note 270 leaves the skew correct mechanism 200 with its leading edge 268 parallel to the axes of the shafts 226–232.

As previously mentioned, the belts 202–208 and the pulleys 238, 240 are normally in the positions shown in solid outline in FIG. 6. The leading edge 268 (FIG. 7) of a currency note 270 arriving at the skew corrector mechanism 200 will enter the nips of the belts 202, 204 and 206, 208, and the note 270 will be fed through the mechanism 200 by virtue of being gripped between the cooperating parts of the belts 202, 204 and 206, 208. With the belts 202–208 in their normal positions, the note 270 will be fed straight through the mechanism 200 without any change in the orientation of the leading edge 268 of the note 270 relative to the axes of the shafts 226–232. The outputs of the sensor means 262 and 264 for sensing the leading edge 268 of the note 270 are applied to an electronic control unit 276 which serves to control the operation of the motors 254, 256. Timing pulses generated by the timing disc sensor 260 are also applied to the electronic control unit 276. During the arrival of the note 270 at the skew correct mechanism 200, if the sensor means 262 and 264 sense the leading edge 268 of the note 270 simultaneously (which is the case if the note 270 has the correct orientation for feeding to the verifier 274), then the electronic control unit 276 will allow the motors 254, 256 to remain non-operated, so that the note 270 will be fed through the mechanism 200 with its leading edge 268 remaining parallel to the axes of the shafts 226–232. If the note 270 has an incorrect orientation as shown in FIG. 7 such that the sensor means 264 sense the leading edge 268 prior to the sensor means 262 sensing the leading edge 268, then the electronic control unit 276 will send an appropriate signal to the motor 256 so as to operate the motor 256 in such a sense as to rotate the assembly of the arm 250 and pulley 240 in a clockwise direction with reference to FIG. 6, thereby bringing about a deformation of the cooperating parts of the belts 206, 208 to a position such as the position 206', 208' shown in FIG. 6. The extent of rotation of the arm 250 and pulley 240, and hence the amount of deformation of the cooperating parts of the belts 206, 208, is determined by the electronic control unit 276 on the basis of how many timing pulses are applied to it by the timing disc sensor 260 in the period between the sensing of the leading edge 268 by the sensor means 264 and the sensing of the leading edge 268 by the sensor means 262. The greater this period, the greater will be the amount of deformation of the cooperating parts of the belts 206, 208. With the cooperating parts of the belts 206, 208 deformed as just described, it will be appreciated that, as the note 270 is fed through the skew corrector mechanism 200, that part of the note 270 which is gripped by the belts 206, 208 (i.e. the part of the note 270 adjacent the side edge 278) will pass along a longer feed path than does that part of the note 270 which is gripped by the belts 202, 204 (i.e. the part of the note 270 adjacent the side edge 280). Thus, as the note 270 is fed through the mechanism 200, the note 270 will be gradually rotated about its center in a counter-clockwise direction with reference to FIG. 7. The electronic control unit 276 is arranged to control the amount of deformation of the cooperating parts of the belts 206, 208 such that, regardless of the amount by which the note 270 is skewed relative to the axes of the shafts 226–232 as the note 270 approaches the mechanism 200, the leading edge 268 of the note 270 will be parallel to these axes when the note 270 leaves the mechanism 200. After the note 270 leaves the mechanism 200, the electronic control unit 276 will cause the motor 256 to be operated in a manner such as to return the pulley 240 and the belts 206, 208 to their normal positions.

Figure 7:
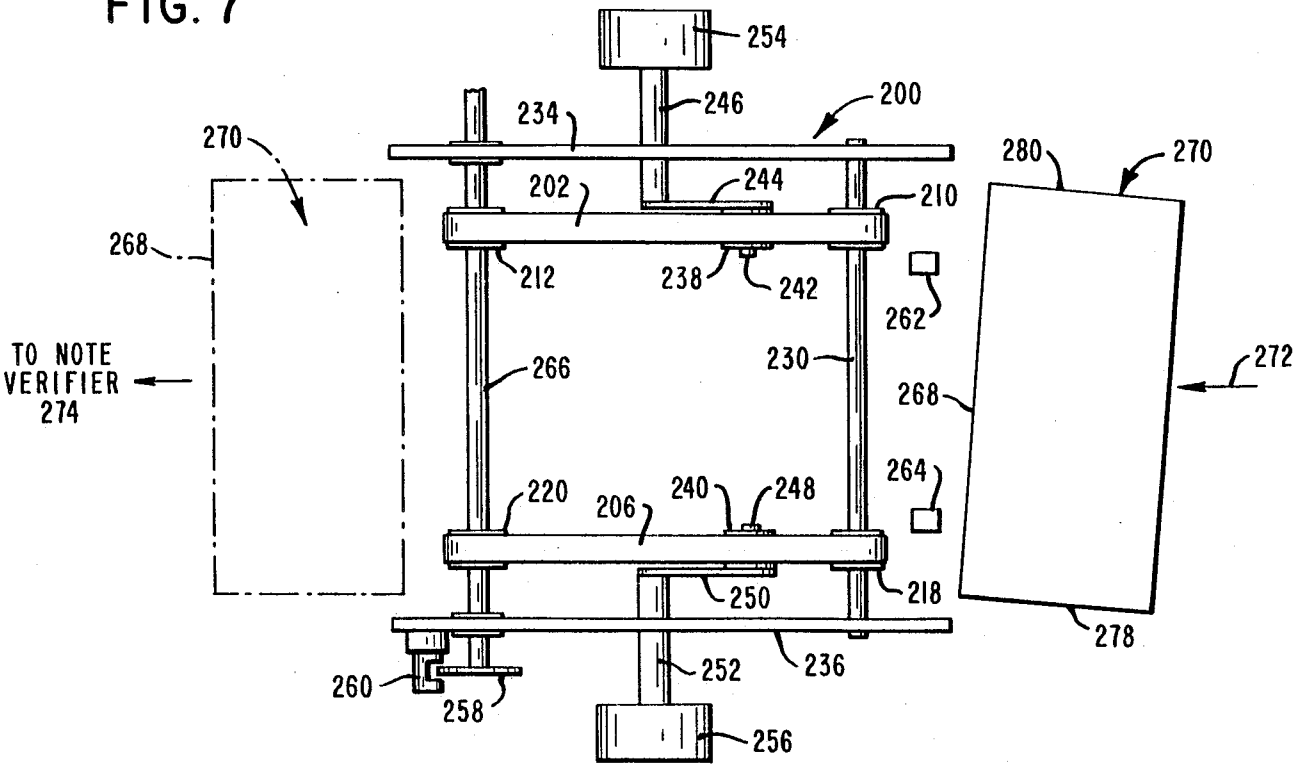
FIG. 7 is a plan view of the mechanism shown in FIG. 7.

If a note 270 approaches the skew corrector mechanism 200 in a skewed condition opposite to the skewed condition shown in FIG. 7 (i.e. in a condition such that part of the note 270 adjacent the side edge 280 will be sensed by the sensor means 262 prior to that part of the note 270 adjacent the side edge 278 being sensed by the sensor means 264), then in this case the electronic control unit 276 will send an appropriate signal to the motor 254 so as to operate the motor 254 in such a sense as to rotate the assembly of the arm 244 and pulley 238 in a clockwise direction with reference to FIG. 6, thereby bringing about a deformation of the cooperating parts of the belts 202, 204 in a similar manner to the previously described deformation of the cooperating parts of the belts 206, 208. In this case, as the note 270 is fed through the mechanism 200, that part of the note 270 adjacent the side edge 280 will pass along a longer feed path than does that part of the note 270 adjacent the side edge 278. As in the case of the deformation of the belt 206, 208, the electronic control unit 276 is arranged to control the amount of deformation of the cooperating parts of the belts 202, 204 such that, regardless of the amount by which the note 270 is skewed relative to the axes of the shafts 226–232 as the note 270 approaches the mechanism 200, the leading edge 268 of the note 270 will be parallel to these axes when the note leaves the mechanism 200. After the note 270 leaves the mechanism 200, the electronic control unit 276 will cause the motor 254 to be operated in a manner such as to return the pulley 238 and the belts 202, 204 to their normal positions.

It should be understood that, during a skew-correcting rotation of a note 270 as it is fed through the mechanism 200 following operation of one or other of the motors 254 and 256, a certain amount of slippage occurs between the note 270 and the contacting parts of the surfaces of the belts 202–208. The surfaces of the belts 202–208 are arranged to be sufficiently smooth, consistent with effective feeding of the note 270, to permit such slippage to occur without any wrinkling of the note 270 taking place.

It will be appreciated that the skew corrector mechanism 200 ensures that a note 270 to be verified arrives at the note verifier 274 (FIG. 8) with a correct orientation such as to enable the verifier 274 to make a determination as to whether or not the note 270 is genuine and is of satisfactory condition. If the verifier 274 determines that the note 270 is genuine and is of satisfactory condition, then the note 270 is permitted by the verifier 274 to pass to a storage location (not shown). If the verifier 274 fails to determine that the note is genuine, or finds that the note 270 is in a non-satisfactory condition (e.g. is torn or has adhesive tape attached thereto), then the verifier 274 sends an appropriate signal to the electronic control unit 276 which in turn brings about operation of a divert means 282 (FIG. 8) so as to cause the note 270 to be diverted to a reject bin (not shown) or to be returned to the person from whom it originated.

It should be understood that the skew corrector mechanism 200 described above with reference to FIGS. 6 to 8 provides a simple and effective means for correcting for skew of a document over a wide range of possible amounts of skew, and which skew may be in either of two opposite senses relative to a fixed axis.

What is claimed is:

1. A sheet moving apparatus comprising:

first and second belt means for moving a sheet along a path of movement from a first point to a second point in said apparatus;

said first belt means including first and second belts, and said second belt means including first and second belts;

said first belts of said first and second belt means having cooperating portions to enable said sheet to be moved therebetween;

said second belts of said first and second belt means having cooperating portions to enable said sheet to be moved therebetween;

sensing means to detect the leading edge of said sheet entering said apparatus and to provide an output indicative of the orientation of said leading edge relative to said path of movement in said apparatus;

said first and second belts of said first and second belt means being endless belts made of resilient stretchable material;

first actuating means for stretching said cooperating portions of said first belts of said first and second belt means so as to change the lengths thereof; and second actuating means for stretching said cooperating portions of said second belts of said first and second belt means so as to change the lengths thereof; and control means for controlling the operation of said first and second actuating means so as to stretch, when necessary, said cooperating portions of said first and second belts of said first and second belt means in response to said output of said sensing means so as to align the leading edge of said sheet perpendicular to said path of movement as said sheet is moved from said first point to said second point.

2. The sheet moving apparatus as claimed in claim 1 in which said first actuating means includes a member positioned relative to said first belts of said first and second belt means to simultaneously stretch the associated cooperating portions of said first belts of said first and second belt means, and in which said second actuating means includes a member positioned relative to said second belts of said first and second belt means to simultaneously stretch the associated cooperating portions of said second belts of said first and second belt means.

3. A sheet moving apparatus comprising:

first and second belt means for moving a sheet along a path of movement from a first point to a second point in the apparatus;

said first belt means including:

first, second, third, and fourth pulleys having fixed axes of rotation;

a first endless belt mounted on said first and second pulleys; and a second endless belt mounted on said third and fourth pulleys;

said second belt means including:

first, second, third, and fourth pulleys having fixed axes of rotation;

a first endless belt mounted on said first and second pulleys of said second belt means; and a second endless belt mounted on said third and fourth pulleys of said second belt means;

said first endless belts of said first and second belt means having cooperating portions which define a first feed path for a first part of said sheet;

said second endless belts of said first and second belt means having cooperating portions which define a second feed path for a second part of said sheet, with said first and second paths being spaced from each other;

said first and second belts of said first and second belt means being endless belts made of a resilient stretchable material;

said apparatus further comprising:

drive means including a drive shaft for driving said first and second belt means to move said sheet along said path of movement;

first path altering means for varying the length of said first feed path so as to vary the distance that at least a first part of said sheet travels as the sheet moves from said first point to said second point;

said first path altering means including an actuating pulley and a selectively operable actuating means which is operable on said actuating pulley to lengthen and shorten said first feed path, respectively , when said actuating pulley is moved in first and second directions;

second path altering means for varying the length of said second feed path so as to vary the distance that a second part of said sheet travels as the sheet moves from said first point to said second point;

said second path altering means including an actuating pulley and a selectively operable actuating means which is operable on said last named actuating pulley to lengthen and shorten said second feed path, respectively, so as to vary the distance that said second part of said sheet travels as the sheet moves from said first point to said second point;

sensing means to detect the leading edge of said sheet entering said apparatus and to provide an output indicative of the orientation of said leading edge relative to said path of movement in said apparatus;

timing means to generate a series of timing pulses whose frequency is dependent on the speed of rotation of said drive shaft; and electronic control means for controlling said first and second path altering means on the basis of the output of said sensing means and said timing pulses so as to change the lengths of said first and second feed path, when necessary, so as to enable the leading edge of said document to arrive at said second point at a substantially perpendicular orientation relative to said path of movement.

4. The sheet handling apparatus as claimed in claim 3 in which said actuating pulley of said first path altering means is located between said first endless belt of said first belt means so as to stretch and thereby lengthen said cooperating portions of said first belts of said first and second belt means when said last named pulley is moved in a first direction, and in which said actuating pulley of said second path altering means is located between said second endless belt of said first belt means so as to stretch and thereby lengthen said cooperating portions of said second belts of said first and second belt means when said last named pulley is moved in said first direction.

5. The sheet moving apparatus as claimed in claim 4 in which said sensing means includes first and second sensors which are spaced apart in a direction which is perpendicular to said path of movement.

* * * * *